US006812444B2

(12) United States Patent
Ahn

(10) Patent No.: US 6,812,444 B2
(45) Date of Patent: Nov. 2, 2004

(54) DEVICE FOR COOLING THE ELECTRONIC EQUIPMENT OF A MICROWAVE OVEN

(75) Inventor: Seong-Soon Ahn, Changwon (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/898,019

(22) Filed: Jul. 5, 2001

(65) Prior Publication Data

US 2002/0084266 A1 Jul. 4, 2002

(30) Foreign Application Priority Data

Dec. 28, 2000 (KR) ..... 2000-84684

(51) Int. Cl.[7] ..... H05B 6/80

(52) U.S. Cl. ..... 219/757; 219/756; 126/21 A; 126/299 D

(58) Field of Search ..... 219/757, 681, 219/746, 756; 126/21 A, 299 D, 299 R, 273 R, 275 E

(56) References Cited

U.S. PATENT DOCUMENTS

| | | | | |
|---|---|---|---|---|
| 4,184,945 A | | 1/1980 | Morgan et al. | 219/757 |
| 4,282,416 A | | 8/1981 | White | 219/756 |
| 4,313,043 A | | 1/1982 | White et al. | 219/756 |
| 4,314,126 A | * | 2/1982 | Yoshimura et al. | 219/757 |
| 4,327,274 A | * | 4/1982 | White et al. | 219/757 |
| 4,418,261 A | * | 11/1983 | Jailor et al. | 219/757 |
| 4,618,756 A | * | 10/1986 | Schwaderer et al. | 219/757 |
| 5,442,161 A | | 8/1995 | Matsushima | 219/756 |
| 6,218,654 B1 | * | 4/2001 | Braunisch | 219/757 |
| 6,278,099 B1 | * | 8/2001 | Kang | 219/757 |

FOREIGN PATENT DOCUMENTS

| | | | |
|---|---|---|---|
| EP | 0110364 | 6/1984 | 219/756 |
| JP | 58-203322 | 11/1983 | 219/756 |

* cited by examiner

*Primary Examiner*—Philip H. Leung
(74) *Attorney, Agent, or Firm*—Fleshner & Kim, LLP

(57) ABSTRACT

The present invention relates to a microwave oven, and more particularly, to a device for cooling electric equipments of hooded microwave oven. The device comprises a ventilation motor assembly 40 mounted on the top of a cavity 20, for forming both a flow of air for a hood function and a flow of air for dissipating heat from the electric equipments; and a suction grill 50 through which outer air is sucked to the top of the cavity 20 by suction force of the ventilation motor assembly 40. The electric equipments are positioned in a flow of the air that is sucked through the suction grill 50 to the top of the cavity 20 and flows to the ventilation motor assembly 40. According to the present invention, since a flow of air for dissipating heat from the electric equipments is linearly formed, its cooling efficiency and the reliability of the electric equipments are enhanced.

10 Claims, 4 Drawing Sheets

DEVICE FOR COOLING THE ELECTRONIC EQUIPMENT OF A MICROWAVE OVEN

FIELD OF INVENTION

The present invention relates to a microwave oven, and more particularly, to a device for cooling electric equipments in hooded microwave oven constructed to efficiently cool the electric equipments.

BACKGROUND OF INVENTION

Hooded microwave oven is mounted on the top of a gas oven range, and has a hood function of discharging hot air or smoke generated from the gas oven range.

FIG. 1 is a perspective view showing a structure for cooling an electric equipment installation chamber of a conventional hooded microwave oven.

A cavity 1 and an electric equipment installation chamber 3 are formed in the interior of the conventional hooded microwave oven. Cooking is done in the interior of the cavity 1. Electric equipments which generate a microwave for performing the cooking in the interior of the cavity 1 are mounted on the electric equipment installation chamber 3. In order to cool the electric equipments in the electric equipment installation chamber 3, outer air is sucked through a suction grill 7. The suction grill 7 is formed at one side of a front surface of the microwave oven.

Meanwhile, a magnetron 8 for generating the microwave is mounted on a side surface T for partitioning the microwave oven into the cavity 1 and the electric equipment installation chamber 3. The magnetron 8 is mounted on a relatively upper portion of the electric equipment installation chamber 3. A wave-guide 9 is mounted for guiding the microwave generated by the magnetron 8 to the interior of the cavity 1 and is connected to the magnetron 8.

A bottom plate 5 defines a bottom surface of the electric equipment installation chamber 3. A high voltage transformer 10 and a high voltage capacitor 11 are mounted on the bottom plate 5. The high voltage transformer 10 enables the magnetron 8 to generate the microwave and induces a high voltage. The high voltage capacitor 11 is a portion for accumulating the high voltage. Here, when the microwave is generated, heat is relatively largely generated from the magnetron 8 and the high voltage transformer 10.

Meanwhile, an air guide 12 is provided for guiding the air that has just cooled the magnetron 8 to a ventilation motor assembly 13 to be described below. The air guide 12 enables the magnetron 8 to communicate with an inlet of the ventilation motor assembly 13.

The ventilation motor assembly 13 performs a hood function in hooded microwave oven, and a function of forming a flow of air for cooling the electric equipments in the electric equipment installation chamber 3.

Next, a partitioning wall 14 is installed across the top of the cavity 1 from the ventilation motor assembly 13 to the suction grill 7, and guides the air sucked through the suction grill 7 not to be scattered.

In the conventional hooded microwave oven as described above, the flow of air for cooling the electric equipments in the electric equipment installation chamber 3 is established as follows:

When the ventilation motor assembly 13 sucks an ambient air and discharges it to the outside, the interior of the microwave oven is under a low pressure state. Due to this, an outer air is sucked through the suction grill 7. At this time, a greater portion of the sucked air linearly flows toward the ventilation motor assembly 13. A portion of the air dissipates heat from the magnetron 8 attached to the side surface T of the electric equipment installation chamber 3, and the other portion of the air cools the high voltage transformer 10, the high voltage capacitor 11, etc. in a lower portion of the electric equipment installation chamber 3.

The air that has dissipated heat from the magnetron 8 is sucked through the air guide 12 to the ventilation motor assembly 13 positioned on the top side of the electric equipment installation chamber 3, and is discharged to the outside. The air that has dissipated heat from the electric equipments in the lower of the electric equipment installation chamber 3 flows upwardly, is sucked to the ventilation motor assembly 13 through a portion which is not covered by the air guide 12, and is then discharged to the outside.

However, there are some problems in the prior art as follows:

A majority of the air drawn through the suction grill 7 to the interior of the microwave oven by the ventilation motor assembly 13 linearly flows toward the ventilation motor assembly 13. Thus, since only little portion of the drawn air is transferred to electric equipments mounted on the bottom plate 5, cooling thereof is not sufficient.

That is, the velocity of the air drawn from the suction grill 7 having a smaller area to the interior of the electric equipment installation chamber 3 having a greater volume is abruptly lowered and a majority of the introduced air flows directly toward the ventilation motor assembly 13.

Particularly, since the air transferred to the high voltage transformer 10, etc. positioned at the lower portion of the electric equipment installation chamber 3 flows over a long distance, it slows down and the heat dissipating efficiency thereof is deteriorated. Therefore, after the microwave oven has been used for a long time, a reliability problem of the electric equipments due to overheat may be issued.

On the other hand, in order to solve the above reliability problem of the electric equipments, the electric equipments should be designed and manufactured to minimize an amount of heat generation. This results in high manufacturing costs thereof.

Further, in order to increase an amount of the sucked air and the velocity of the air by increasing the suction force of the ventilation motor assembly 13, the rotation speed of a ventilation motor should be increased. This also results in much noise and increased consumption of power.

SUMMARY OF INVENTION

Therefore, the present invention is conceived to solve the above problems. It is an object of the present invention to maximize efficiency of cooling electric equipments.

It is another object of the present invention to provide a microwave oven wherein less noise is generated and consumption of power is low.

According to features of the present invention for achieving the above objects, there is provided a device for cooling electric equipments of hooded microwave oven, comprising: a ventilation motor assembly mounted on the top of a cavity, for forming both a flow of air for a hood function and a flow of air for dissipating heat from the electric equipments; and a suction grill which is a passage through which outer air is sucked to the top of the cavity by suction force of the ventilation motor assembly. The electric equipments are positioned in a flow path of the air that is sucked through the suction grill and flows to the ventilation motor assembly.

A bottom plate for defining a bottom surface of an electric equipment installation chamber, in which the electric equipments are mounted, may be mounted at a top end of the cavity. Thus, the electric equipments are positioned in the flow path of the air flowing from the suction grill to the ventilation motor assembly.

A magnetron of the electric equipments may be mounted on a side surface of the cavity. A passage hole for guiding the air to the magnetron may be formed on the bottom plate. The air that has passed by the magnetron may be guided to the ventilation motor assembly by an air guide.

The magnetron of the electric equipments may be mounted on the bottom plate and adjacent to an inlet of the ventilation motor assembly.

A wave-guide for guiding a microwave generated by the magnetron to the interior of the cavity may be mounted on a bottom surface of the magnetron and on the side surface of the cavity.

According to the above constitution, since the flow path of the air for cooling the electric equipments is formed in one direction, its cooling efficiency is maximized and the reliability of the electric equipments is guaranteed. In addition, noise generated from the ventilation motor assembly can be minimized.

DETAILED DESCRIPTION FOR PREFERRED EMBODIMENT

Figure 1:
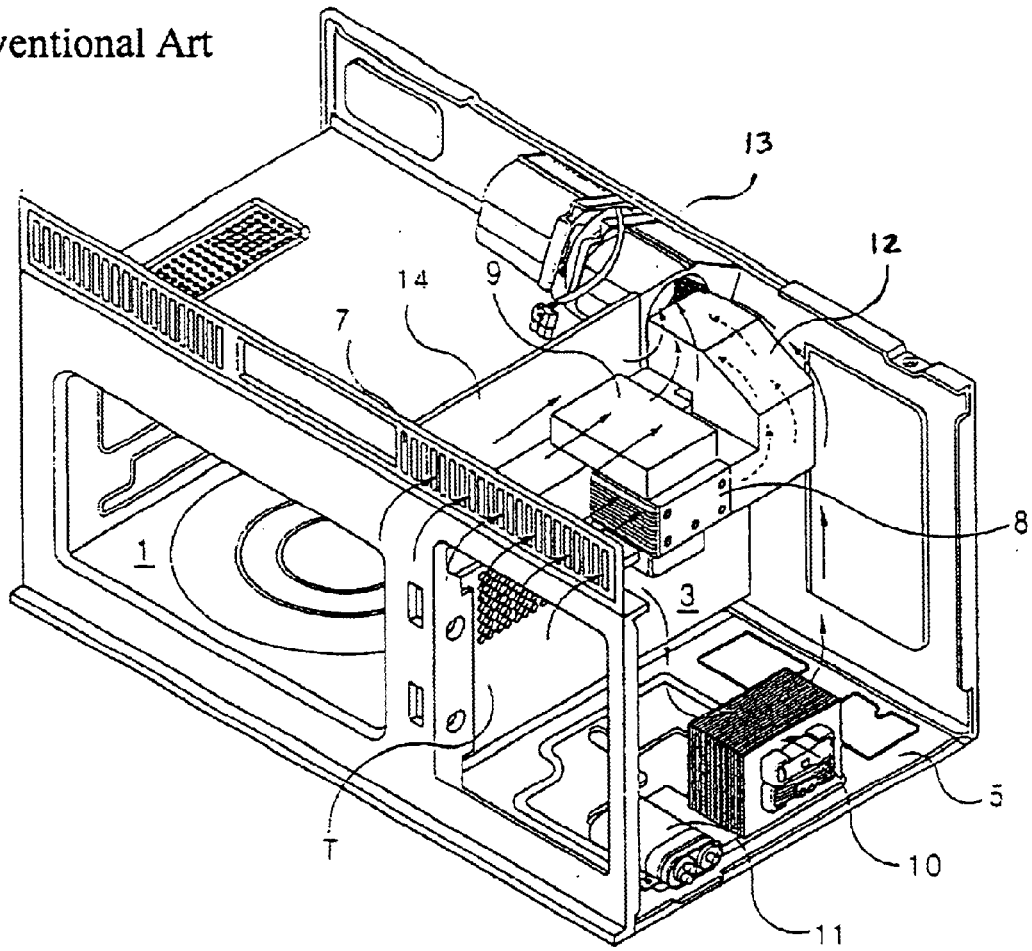
Fig. 1 Conventional Art
FIG. 1 is a perspective view showing a flow of air for cooling electric equipments in a conventional hooded microwave oven.
Figure 2:
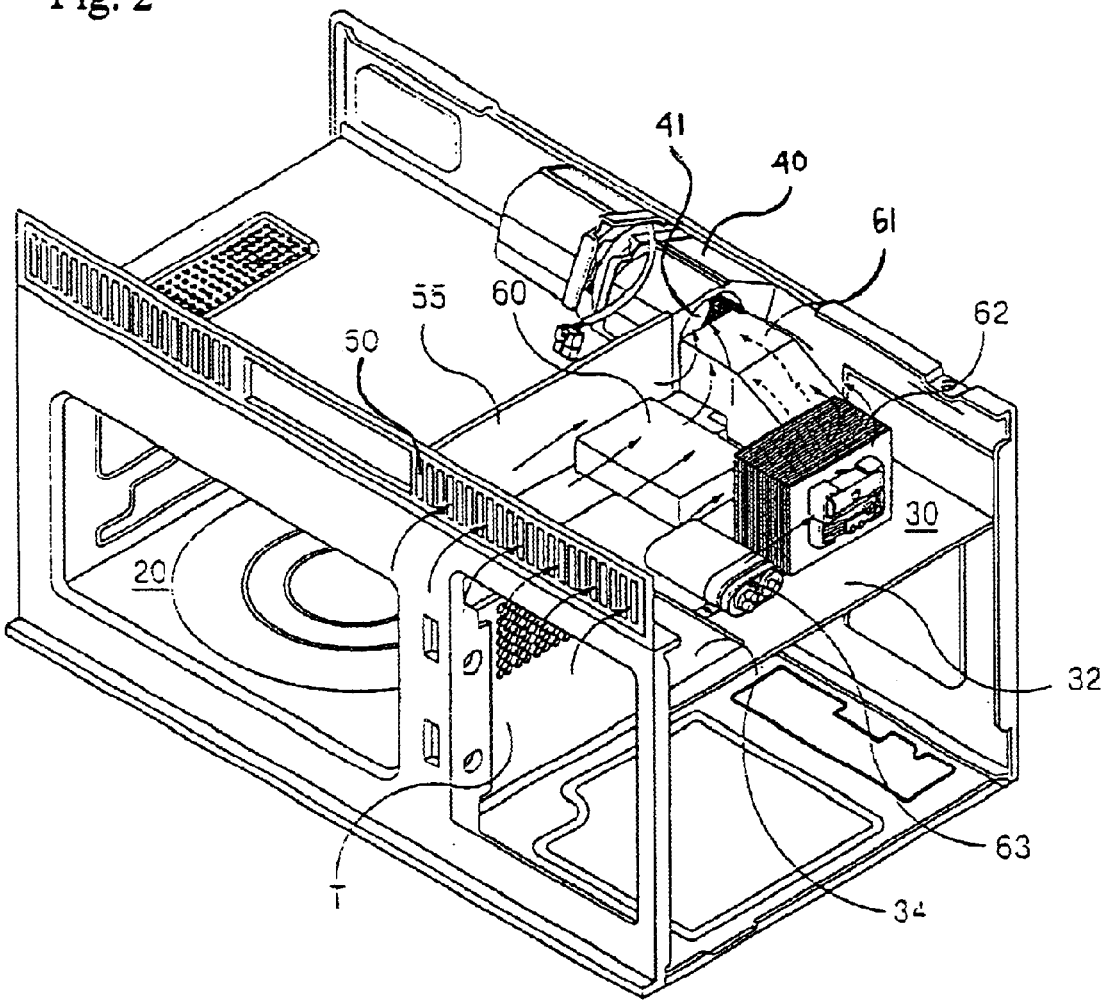
FIG. 2 is a perspective view showing one embodiment of a device for cooling electric equipments according to the present invention and a flow of air in the device.

Hereinafter, a preferred embodiment of the present invention will be explained in detail with reference to FIG. 2 of the accompanying drawings. FIG. 2 is a perspective view of a microwave oven of the present invention with parts for constituting an outward appearance of the microwave oven, such as outer case, door, etc., removed.

A cavity 20 in which foodstuffs are cooked, and an electric equipment installation chamber 30 an upper portion of which has electric equipments mounted therein are formed in the microwave oven. A bottom plate 32 defines a bottom surface of the electric equipment installation chamber 30. The bottom plate 32 is installed at a position corresponding to a top end of the cavity 20. Thus, the electric equipment installation chamber 30 is placed at a position corresponding to the top end of the cavity 20. A passage hole 34 for guiding air to a magnetron to be described below is formed in the bottom plate 32 at a position adjacent to a suction grill 50.

A ventilation motor assembly 40 is mounted at the rear of the top of the cavity 20, sucks ambient air to two suction inlets 41 at both ends thereof and discharges it to the outside. The ventilation motor assembly 40 forms both a flow of air for a hood function through a hood inlet 43, a cooling chamber inlet 45, and a cooling chamber outlet 47 to be exhausted through a suction port 41; and a flow of air for cooling the electric equipments in the electric installation chamber 30 through the suction grill 50 to be exhausted through a suction port 41. That is, the air for the hood function is sucked through a suction port 41 on one side, and the air for the cooling function is sucked through a suction port 41 on the other side.

In order to suck outer air into the electric equipment installation chamber 30 by driving force of the ventilation motor assembly 40, the suction grill 50 is formed at a portion corresponding to a front surface of the electric equipment installation chamber 30. Furthermore, in order to guide the air flowing from the suction grill 50 to the ventilation motor assembly 40, a partitioning wall 55 is mounted at the top of the cavity 20. The partitioning wall 55 partitions the top of the cavity 20 into a portion which communicates with the electric equipment installation chamber 30 and a portion which does not communicate with the electric equipment installation chamber 30.

A magnetron (not shown) for generating a microwave transferred to the interior of the cavity 20 is mounted on a side surface T of the cavity 20 adjacent to the ventilation motor assembly 40. The magnetron is mounted on the side surface T of the cavity 20 at a position corresponding to a lower end of the bottom plate 32. In addition, a wave-guide 60 for guiding the microwave generated by the magnetron to the interior of the cavity 20 is simultaneously seated to the bottom plate 32 and the side surface T of the cavity 20. Furthermore, an air guide 61 is mounted for guiding the air, which has performed heat dissipation action while passing by the magnetron, to the ventilation motor assembly 40. The air guide 61 allows one side of the magnetron to communicate with a portion of the suction port 41 on the one side of ventilation motor assembly 40.

Next, a variety of electric equipments are mounted on the bottom plate 32. For example, a high voltage transformer 62 and a high voltage capacitor 63 are mounted for supplying the magnetron with a high voltage. Since the high voltage transformer 62 and the high voltage capacitor 63 are mounted on the bottom plate 32, they are positioned in a stream of air transferred through the suction grill 50 to the ventilation motor assembly 40.

Hereinafter, the operation of this embodiment having the above constitution will be explained.

The ventilation motor assembly 40 provides suction force for a hood function by which hot air, smoke and the like generated from an oven range installed under the microwave oven are discharged. In the present embodiment, with the suction force provided by the ventilation motor assembly 40, a flow of air for cooling the electric equipments is formed.

That is, in order to perform cooking in the cavity 20, a microwave should be supplied from the magnetron to the interior of the cavity 20. Thus, in the process of generating the microwave, a great amount of heat is produced from the magnetron, the high voltage transformer 62 and the high voltage capacitor 63. For the purpose of dissipating the generated heat, the ventilation motor assembly 40 is driven.

When the ventilation motor assembly 40 is driven, outer air is sucked through the suction grill 50 and flows into the electric equipment installation chamber 30. The air sucked into the electric equipment installation chamber 30 flows toward the ventilation motor assembly 40. During this flow process, the sucked air performs heat dissipation action while passing by the high voltage transformer 62 and the high voltage capacitor 63.

A portion of the air sucked through the suction grill 50 is transferred through the passage hole 34 to the magnetron, performs heat dissipation action while passing by the magnetron, and is sucked through the air guide 61 to the suction port 41 by the suction force of the ventilation motor assembly 40. The air sucked to the ventilation motor assembly 40 is discharged via a separate path to the outside of the microwave oven.

According to this embodiment of the present invention operated as such, the electric equipments on the bottom plate 32, which are installed at a level adjacent to the ventilation motor assembly 40, are efficiently cooled by the linear flow of air flowing from the suction grill 50 to the ventilation motor assembly 40.

Figure 3:
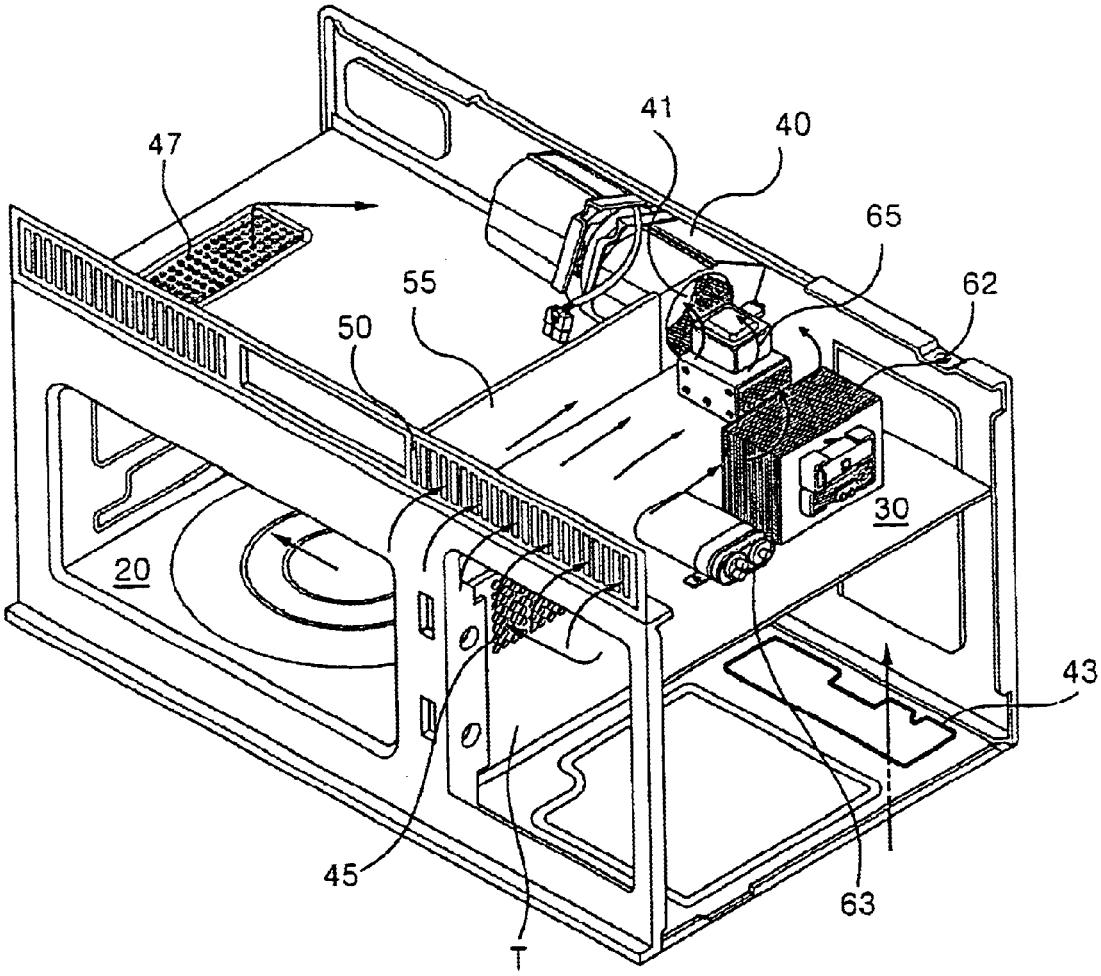
FIG. 3 is a perspective view showing the constitution of another embodiment of the present invention and a flow of air therein.
Figure 4:
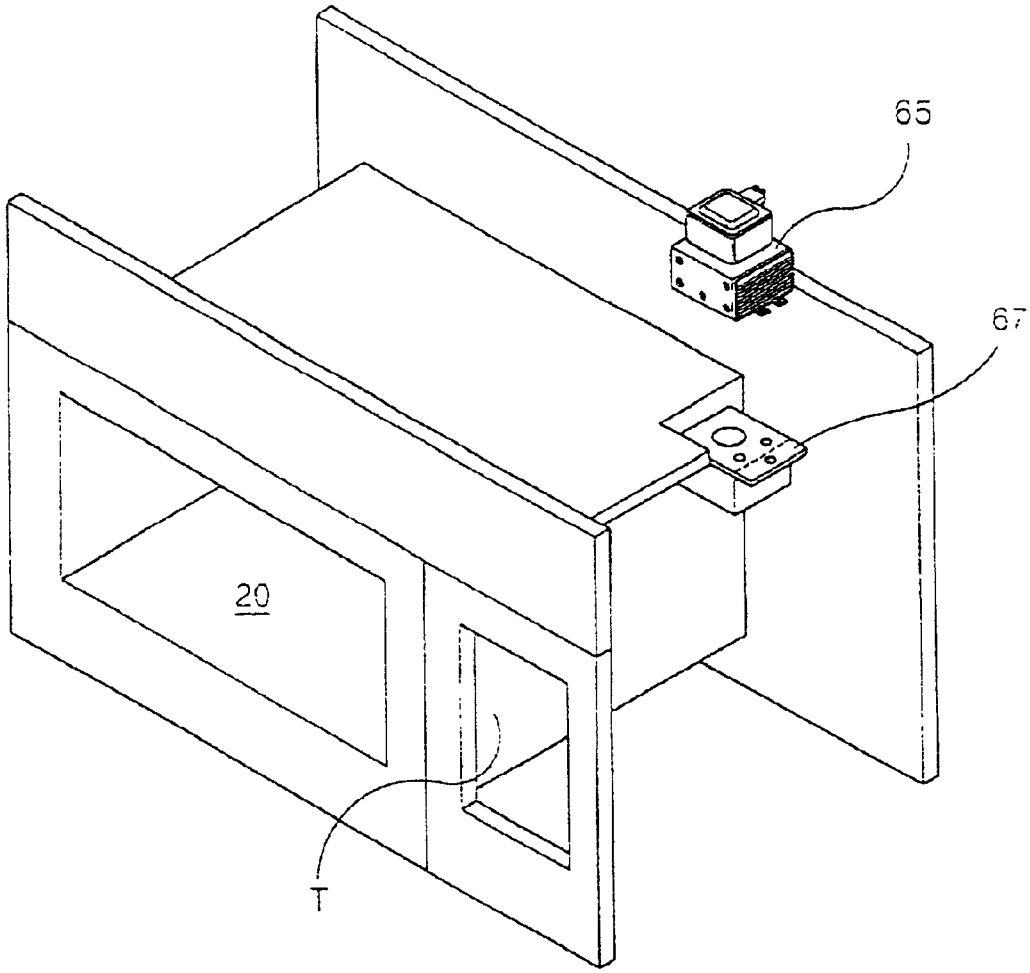
FIG. 4 is an exploded perspective view showing a mounting state of a wave-guide and a magnetron in the embodiment shown in FIG. 3.

Meanwhile, FIGS. 3 and 4 show another embodiment of the present invention.

In this embodiment, a magnetron 65 for generating a microwave for cooking foodstuffs in the interior of the cavity 20 is mounted on the bottom plate 32. A wave-guide 67 for guiding the microwave generated by the magnetron 65 to the interior of the cavity 20 is simultaneously mounted on a lower portion of the magnetron 65 and on the side surface T of the cavity 20. Therefore, it is not necessary to provide the bottom plate 32 with the passage hole 34 for guiding the sucked air downwardly. With the exception of these differences, since the constitution of this embodiment is the same as the previous embodiment, the detailed descriptions thereof will be omitted.

In this embodiment described above, since the bottom plate 32 is installed at a relatively higher position and the magnetron 65, the high voltage transformer 62 and the high voltage capacitor 63 mounted on the bottom plate 32 is in the flow of air flowing from the suction grill 50 to the ventilation motor assembly 40, efficiency of cooling the electric equipments further increases.

As described above, according to the present invention, since the flow of air for cooling the electric equipments is linearly formed by installing the electric equipments at a position corresponding to the top of the cavity, the efficiency of cooling the electric equipments is greatly enhanced. Therefore, the damage to them due to overheat is prevented and their operating reliability is enhanced.

Further, since the heat dissipation is smoothly performed, there is no need to use heat resistant materials in view of the design of the electric equipments. Therefore, there is an advantage that material costs of the electric equipments are saved.

Furthermore, since the rotation speed of the ventilation motor assembly is lower than that of the conventional ventilation motor assembly upon operation thereof to obtain the same heat dissipation effect as the conventional one, less noise is generated and the consumption of power for driving the ventilation motor assembly is minimized.

Furthermore, in another embodiment of the present invention, since the air guide can be omitted by changing the mounting position of the magnetron, costs of parts and assembly are reduced and the productivity is enhanced.

Finally, since a lower space of the electric equipment installation chamber can be sufficiently utilized, space availability, e.g., expansion of the cavity and ability of mounting other functional parts such as heater and the like, can be maximized.

It should be understood that a person skilled in the art to which the invention pertains may make various modifications to the present invention within the scope of the present invention.

What is claimed is:

1. A microwave oven, comprising:

a plurality of electronic components disposed above a top and to a first side of a cooking chamber of the microwave oven;

an air inlet in a first side of the microwave oven;

a first fan and a second fan disposed above the top of the cooking chamber, wherein the first fan moves air along a first air flow path and the second fan moves air along a second air flow path, wherein the first air flow path is configured to cool the electronic components and the second air flow path proximate to the plurality of electronic components; and an exhaust hood air flow path is configured to exhaust fumes from a cooking range disposed below the microwave oven, wherein the first air flow path and the second air flow path are separate; and a motor configured to drive both the first fan and the second fan.

2. The microwave oven of claim 1, wherein the electronic components are disposed in an electronic component chamber, and wherein the air inlet forms a side of the electronic component chamber.

3. The microwave oven of claim 2, further comprising a magnetron disposed proximate to the first fan.

4. The microwave of claim 2, further comprising a magnetron disposed adjacent a separate duct.

5. A microwave oven, comprising:

a ventilation motor disposed above a cooking chamber;

an exhaust air flow path configured to vent fumes from a cooking range disposed below the microwave oven;

an exhaust fan configured to be driven by the ventilation motor and to move air along the exhaust air flow path;

a cooling air flow path configured to cool a plurality of electronic components disposed in an electronic component chamber above a plane defined by a top of the cooking chamber; and a cooling fan configured to be driven by the ventilation motor and to move air along the cooling air flow path wherein the cooling air flow path is separate from the exhaust air flow path.

6. The microwave oven of claim 5, wherein an air inlet for the cooling airflow path forms a side of the electronic component chamber.

7. The microwave oven of claim 6, further comprising a magnetron disposed proximate to the cooling fan.

8. The microwave oven of claim 5, wherein the plurality of electronic components is disposed above a top and to a first side of a cooking chamber of the microwave oven.

9. The microwave oven of claim 5, further comprising a magnetron disposed proximate to the cooling fan.

10. The microwave of claim 5, further comprising a magnetron, wherein the magnetron is disposed in a separate duct.

* * * * *